US011259561B2

(12) United States Patent
Sanna

(10) Patent No.: US 11,259,561 B2
(45) Date of Patent: Mar. 1, 2022

(54) ROD WITH WRAPPER COMPRISING GLUING CAVITIES

(71) Applicant: PHILIP MORRIS PRODUCTS S.A., Neuchatel (CH)

(72) Inventor: Daniele Sanna, Marin-Epagnier (CH)

(73) Assignee: Philip Morris Products S.A., Neuchatel (CH)

( * ) Notice: Subject to any disclaimer, the term of this patent is extended or adjusted under 35 U.S.C. 154(b) by 56 days.

(21) Appl. No.: 16/497,519

(22) PCT Filed: May 25, 2018

(86) PCT No.: PCT/EP2018/063827
§ 371 (c)(1),
(2) Date: Sep. 25, 2019

(87) PCT Pub. No.: WO2018/219826
PCT Pub. Date: Dec. 6, 2018

(65) Prior Publication Data

US 2020/0337368 A1 Oct. 29, 2020

(30) Foreign Application Priority Data

May 31, 2017 (EP) ..... 17173650

(51) Int. Cl.
*A24C 5/24* (2006.01)
*A24C 5/00* (2020.01)
(Continued)

(52) U.S. Cl.
CPC ..... *A24C 5/24* (2013.01); *A24C 5/005* (2013.01); *A24C 5/472* (2013.01); *A24D 1/02* (2013.01)

(58) Field of Classification Search
CPC ..... A24C 5/01; A24C 5/18; A24B 3/14
See application file for complete search history.

(56) References Cited

U.S. PATENT DOCUMENTS 3,240,212 A 3/1966 Royster
5,107,866 A 4/1992 Aronoff
(Continued)

FOREIGN PATENT DOCUMENTS

CN 103974634 8/2014
CN 104010527 8/2014
(Continued)

OTHER PUBLICATIONS

Office Action issued in Korea for Application No. 10-2019-7033770 dated Aug. 10, 2021 (3 pages). English translation included.
(Continued)

*Primary Examiner* — Eric Yaary
*Assistant Examiner* — Jennifer A Kessie
(74) *Attorney, Agent, or Firm* — Mueting Raasch Group

(57) ABSTRACT

The invention relates to a cylindrical rod (10) for aerosol-generating articles comprising a rod component (12) being circumscribed by a wrapper (14). The wrapper comprises laterally opposed edge portions which overlap so as to form an overlapping zone (16). Glue (24) is applied to the overlapping edge portions of the wrapper, by which the overlapping edge portions are adhered to each other. The glue is applied in such way, so as to form one or more glue zones (22) within the overlapping zone. The wrapper further comprises a plurality of cavities (26), wherein at least a part of the cavities is provided in the one or more glue zones. The invention further relates to a method for preparing a cylindrical rod for aerosol-generating articles.

15 Claims, 4 Drawing Sheets

(51) Int. Cl.
*A24C 5/47* (2006.01)
*A24D 1/02* (2006.01)

(56) References Cited

U.S. PATENT DOCUMENTS

| | | | |
|---|---|---|---|
| 9,307,789 | B2 | 4/2016 | Griesmayr |
| 9,339,059 | B2 | 5/2016 | Griesmayr |
| 9,956,987 | B2 | 5/2018 | Kunishima |
| 2002/0023655 | A1 | 2/2002 | Fietkau |
| 2016/0050970 | A1 | 2/2016 | Bass |
| 2016/0120216 | A1 | 5/2016 | Mironov |

FOREIGN PATENT DOCUMENTS

| | | |
|---|---|---|
| CN | 105357991 | 2/2015 |
| CN | 104648468 | 5/2015 |
| EP | 2837295 | 2/2015 |
| JP | 2004-049167 | 2/2004 |
| JP | 2005-240007 | 9/2005 |
| JP | 2016-523567 | 8/2016 |
| WO | WO 2015066210 | 5/2015 |
| WO | WO 2016/156424 | 10/2016 |
| WO | WO 2017/036951 | 3/2017 |
| WO | WO 2017/042298 | 3/2017 |

OTHER PUBLICATIONS

Office Action issued in Japan for Application No. 2019-562294 dated Dec. 17, 2020 (6 pages). English translation included.
Office Action issued in China for Application No. 201880031591.5 dated Jun. 24, 2021 (8 pages). English translation included.
Liu Zhiming, Researchers on Wheat Straw Surface Characteristics and Wheat Straw Bonding Mechanism, Northeast Forestry University Press, Jun. 2006, pp. 25-26.
PCT Search Report and Written Opinion for PCT/EP2018/063827 dated Aug. 7, 2018 (12 pages).

ROD WITH WRAPPER COMPRISING GLUING CAVITIES

This application is a U.S. National Stage Application of International Application No. PCT/EP2018/063827 filed May 25, 2018, which was published in English on Dec. 6, 2018 as International Publication No. WO 2018/219826 A1. International Application No. PCT/EP2018/063827 claims priority to European Application No. 17173650.7 filed May 31, 2017.

The present invention relates to a cylindrical rod for aerosol-generating articles. The invention further relates to a method for preparing a cylindrical rod for aerosol-generating articles.

It is known in the art to have cylindrical rods for use in aerosol-generating articles. The cylindrical rods comprise a rod component which is circumscribed by a wrapper. Laterally opposed edge portions of the wrapper do overlap in an overlapping zone. The overlapping edge portions of the wrapper are adhered to each other by glue.

Adhesion of the overlapping edge portions has to be sufficiently firm so that it can withstand the physical stress which is applied to the cylindrical rods during manufacture and during handling of the finished product. For example, when the cylindrical rod is squeezed it will be somewhat deformed towards an oval shape. The deformation creates shear forces that may lead to the destruction of the adhesive connection.

Generally, adhesion between the overlapping edge portions of the wrapper is improved by using an increased amount of glue or by increasing the width of the wrapper material resulting in a larger overlapping zone. However, increasing the amount of raw material is usually undesirable, because it makes the manufacturing process more expensive. Additionally, a larger overlapping zone means that a larger part of the circumference of the rod comprises two layers of the wrapper. As a consequence the rod is likely to be less circular in shape.

It would, thus, be desirable to be able to manufacture wrapped cylindrical rods, which provide stronger resistance to physical stress. It would further be desirable to be able to produce such improved wrapped cylindrical rods using existing production machinery.

According to a first aspect of the invention there is provided a cylindrical rod for aerosol-generating articles comprising a rod component being circumscribed by a wrapper. The wrapper comprises laterally opposed edge portions which overlap so as to form an overlapping zone. Glue is applied to the overlapping edge portions of the wrapper, by which the overlapping edge portions are adhered to each other. The glue is applied in such way, so as to form one or more glue zones within the overlapping zone. The wrapper further comprises a plurality of cavities, wherein at least a part of the cavities is provided in the one or more glue zones.

The cavities in the glue zone provide additional anchor surface for the glue. The additional anchorages advantageously improve adhesion. Further, the cavities increase the total glued surface area of the wrapper which improves adhesion. Thus, the wrapper is bound stronger and risk of breaking of the adhesion due to physical stress is reduced. The rod according to the invention advantageously improves adhesion without increasing the width of the wrapper. Hence, a cost-intensive modification of the production machinery is avoided.

A cavity is defined as to be a local modification of the structure of the wrapper. This includes a modification of a surface of the wrapper. The modified part of the surface of the wrapper is defined as to be the surface of the cavity. Generally, the cavity leads to an increase of the surface area of the wrapper.

In some embodiments the cavity is a recess on the wrapper. This means that the thickness of the wrapper is reduced at the location of the cavity. The recess may be created by removal of wrapper material. The recess may also be an indentation which is created by locally compressing the wrapper. Alternatively, the cavity may be created by local corrugations of the wrapper.

In other embodiments the cavity penetrates completely through the wrapper so as to define a through-hole in the wrapper.

In some embodiments the thickness of the wrapper at the location of the cavity is reduced by at least 20 micrometers, by at least 50 micrometers, or by at least 70 micrometers.

The cavities can be of any desired shape. In some embodiments the cavities are of one or more of a cylindrical shape, a pyramidal shape, a cuboid shape, or an irregular shape. In some embodiments the cavities are longitudinal wedges such as scoring lines or creasing lines.

In preferred embodiments the size of a cavity is less than 0.3 millimeter, less than 0.2 millimeter, or less than 0.1 millimeter in diameter.

In some embodiments one or more of different shapes of cavities and different sizes of cavities are used in a single embodiment. In some embodiments recesses and through-holes are used in a single embodiment.

In some embodiments the cavities are created mechanically by debossing, embossing, or pinning. In some embodiments the cavities are created by electrostatic perforation or by laser perforation.

The wrapper is made of a flexible sheet-like material. In some embodiments, the wrapper is one of a plug wrap, a tipping paper, or a cigarette paper. In preferred embodiments the wrapper is made of a fibrous material, for example a cellulosic material. In these embodiments, the creation of a cavity causes the fibrous material to create fringes or spikes of the fibers at the surface of the cavity. The fringes or spikes contribute to a roughening of the surface. Accordingly, in these embodiments the surface of the cavity is rougher than the surface of the wrapper outside the cavity. The roughening of the surface leads to an increase of the surface area. An increased surface area in the glue zone improves the adhesion. Moreover, the roughening of the surface leads to an increased exposure of the fibres. This facilitates lateral penetration of glue into the fibrous material. The facilitated penetration additionally increases adhesion.

The glue zone is defined as to be the portion of the overlapping zone in which glue is present between the two overlapping edge portions of the wrapper. Thus, a cavity in the area of the glue zone is filled with glue. The glue filling the cavity acts like an anchor preventing the overlapping layers of the wrapper to move with respect to one another.

The total glued surface area of the wrapper is the total surface area of the wrapper upon which the glue acts. Hence, the total glued surface area includes the surface area of the side walls of a cavity in the glue zone.

In some embodiments, only part of the wrapper comprises cavities. In particularly preferred embodiments the wrapper comprises cavities in the overlapping zone, only. In some embodiments the wrapper comprises cavities in the one or more glue zones, only.

In these embodiments, advantageously, the air permeability of the cavity-free part of the wrapper is not or only little affected by the presence of the cavities. Moreover, the tensile strength of the cavity-free part of the wrapper is not or only little affected by the presence of the cavities.

Generally, the overlapping zone comprises an inner layer of the wrapper and an outer layer of the wrapper. In some embodiments both the inner layer and the outer layer comprise cavities. In these embodiments the cavities in the opposing layers may be aligned to each other or may be arranged arbitrary to each other. The inner layer is located between the rod component and the outer layer. Thus, the outer layer covers the inner layer of the wrapper. The outer layer of the wrapper comprises an inner surface and an outer surface. The outer surface is visible from the outside of the cylindrical rod. The inner surface is located adjacent to the inner layer of the wrapper.

In some embodiments the outer surface of the outer layer of the wrapper does not comprise cavities and, optionally, the outer layer of the wrapper does not comprise cavities. In some embodiments only the inner layer of the wrapper comprises cavities. In some embodiments only the inner surface of the outer layer of the wrapper comprises cavities and the cavities are recesses.

Accordingly, in those embodiments, the cavities in the overlapping zone are covered by the outer layer. This means that the cavities are not visible from the outside. Hence, the visual appearance of the cylindrical rod is not altered by the presence of the cavities.

Generally, during manufacture of the cylindrical rod one or more lines of glue are applied on the wrapper along a direction in parallel to the cylindrical axis of the later formed rod. The glue can be applied continuously such that continuous lines of glue are formed. Alternatively, the glue can be applied in form of dots of glue such that discontinuous lines of glue are formed.

In some embodiments the cavities are randomly distributed on the wrapper. In preferred embodiments the cavities are arranged on the wrapper in a regular pattern. In some embodiments the cavities are substantially evenly distributed on the wrapper over the whole length of the later formed rod. In some embodiments the cavities are arranged in one or more lines in parallel to the longitudinal axis of the rod.

The lines of glue can be applied directly onto the lines of cavities during manufacture of the cylindrical rod. Thereby, the area of the cavities can be matched to the area of the lines of glue in an efficient manner. Preferably, there are substantially no cavities present outside the glue zone. Moreover, if discontinuous lines of glue are applied each dot of glue can be applied directly onto a cavity.

In some embodiments the cavities are equidistantly arranged in one line with a nearest neighbor distance of between 0.1 millimeter and 0.3 millimeter, between 0.15 millimeter and 0.25 millimeter, or of about 0.2 millimeter. This ensures that the distance between the cavities is long enough such that the structure of the wrapper is not substantially weakened by the cavities. Preferably, the diameter of the cavities is smaller than the distance to the closest cavity. Preferably, the distance to the closest cavity is twice the diameter of the cavity. More preferably, the distance to the closest cavity is three times the diameter of the cavity.

In some embodiments the cavities completely penetrate through the wrapper so as to define through-holes in the wrapper.

The glue may penetrate completely through the through-holes such that the glue adheres the rod component to the underlying wrapper. Thus, the through-holes additionally increase adhesion between the rod component and the wrapper. Hence, the overall adhesion is increased. Further, it is less likely for the rod component to fall out of the wrapper due to the increased adhesion between the wrapper and the rod component. This is particularly advantageous in embodiments, wherein the wrapper is a tipping paper and the rod component is a filter plug.

In some embodiments the outer layer of the wrapper does not comprise any through-holes and, optionally, only the inner layer of the wrapper comprises through-holes.

In a preferred embodiment the inner layer of the wrapper comprises cavities which are through-holes, the inner surface of the outer layer of the wrapper comprises cavities which are recesses, and, optionally, the outer surface of the outer layer of the wrapper does not comprise any cavities. Thus, the through-holes in the inner layer additionally increase adhesion between the rod component and the wrapper. Further, the recesses in the outer layer additionally increase the adhesion between the outer layer of the wrapper and the inner layer of the wrapper.

In a more preferred embodiment the recesses in the outer layer of the wrapper coincide with the through-holes in the inner layer of the wrapper. This means that in the overlapping zone the recesses in the outer layer of the wrapper and the through-holes in the inner layer of the wrapper substantially overlie each other. This has the additional advantage that there is additional adhesion between the rod component and the recesses in the inner surface of the outer layer of the wrapper via the through-holes in the inner layer of the wrapper.

In those embodiments, wherein the outer layer of the wrapper does not comprise any through-holes, the through-holes are not visible from the outside. This has the additional advantage that the outer layer acts as a barrier for the glue because there are no through-holes in the outer layer through which the glue could penetrate. This means that no glue can be accidentally deposited on the outer side of the cylindrical rod. Glue on the outer side of the cylindrical rod is undesired because it may negatively affect the visual appearance of the rod. Further, glue on the outer side of the rod may contaminate the production machinery with glue.

In embodiments wherein the cavities are recesses, which means that the cavities do not completely penetrate through the wrapper, the presence of a cavity creates a caved surface of the wrapper. The surface area of the caved surface exceeds the surface area of the flat wrapper surface in the absence of the cavity. Thereby, the total glued surface area is increased by the presence of the cavity. Thus, the overall adhesion is increased. Accordingly, the wrapper is bound stronger. The risk of breaking of the adhesion due to physical stress is reduced.

In embodiments wherein the cavities are through-holes the surface area is not increased by the presence of the through-hole if the through-hole exceeds a certain maximum size. Thus, if the through-hole is too big the adhesion will not be improved. Accordingly, there is a limitation to the size of the through-hole. The maximum size of the through-hole is dependent from the geometry of the through-hole, the thickness of the wrapper, and the roughness of the newly created surface.

In some embodiments the thickness of the wrapper is between 0.02 millimeter and 0.2 millimeter, between 0.05 millimeter and 0.15 millimeter, or is about 0.1 millimeter and the diameter of each through-hole is smaller than four times the thickness of the wrapper. In some embodiments the thickness of the wrapper is about 0.1 millimeter. In some embodiments the diameter of each through-hole is less than 0.4 millimeter. In some embodiments the diameter of each through-hole is between 0.05 millimeter and 0.35 millimeter, between 0.1 millimeter and 0.3 millimeter, or is about 0.2 millimeter.

Hence, the total surface area on which the glue is applied to act as an adherent is increased by the presence of the through-hole. Accordingly, the overall adhesion is improved. As a consequence the wrapper is bound stronger and the risk of detachment of the outer and inner parts of the wrapper is reduced.

According to another aspect of the invention there is provided an aerosol-generating article comprising a cylindrical rod according to the invention and an aerosol-generating material.

According to another aspect of the invention there is provided a method for preparing a cylindrical rod for aerosol-generating articles. According to the method a wrapper is provided. A plurality of cavities is provided in a lateral edge portion of the wrapper. A rod component is provided and the rod component is placed on a surface of the wrapper. Glue is applied on the lateral edge portion of the wrapper. The rod component is circumscribed with the wrapper such that laterally opposed edge portions of the wrapper overlap so as to form an overlapping zone of the wrapper. The glue adheres the overlapping edge portions to each other. The glued area thereby defines one or more glue zones within the overlapping zone, wherein at least part of the cavities are provided in the one or more glue zones.

The sequence of the step of providing the cavities, the step of providing the rod component and placing the rod component on a surface of the wrapper, and the step of applying glue on the lateral edge portion of the wrapper is arbitrary, with the exception that providing the cavities happens before or simultaneously with the step of applying glue to the lateral edge portion of the wrapper. Accordingly, the order of these steps can be adapted to the particular requirements of a specific embodiment.

In preferred embodiments the cavities are provided before the steps of providing the rod component and placing the rod component on a surface of the wrapper, and applying glue on the lateral edge portion of the wrapper.

In some embodiments of the method the overlapping zone comprises an inner layer of the wrapper and an outer layer of the wrapper and only the inner layer of the wrapper comprises cavities.

In some embodiments of the method the cavities penetrate completely through the wrapper so as to define through-holes in the wrapper.

In some embodiments of the method the cavities penetrate completely through the wrapper so as to define through-holes in the wrapper and the through-holes are provided by perforating the through-holes in the wrapper by electrostatic perforation or by laser perforation with a manufacturing speed of between 700,000 and 1,300,000 through-holes per second on a wrapper moving in a manufacturing direction of between 500 and 900 meters per minute, or the through-holes are provided by a mechanical tool, for example a pinning tool. This has the advantage that the through-holes can be precisely formed at high speed. Thus, the method can be performed at typical production speeds for cylindrical rods for aerosol-generating articles.

Features described in relation to one aspect may equally be applied to other aspects of the invention.

The invention will be further described, by way of example only, with reference to the accompanying drawings in which.

Figure 1:
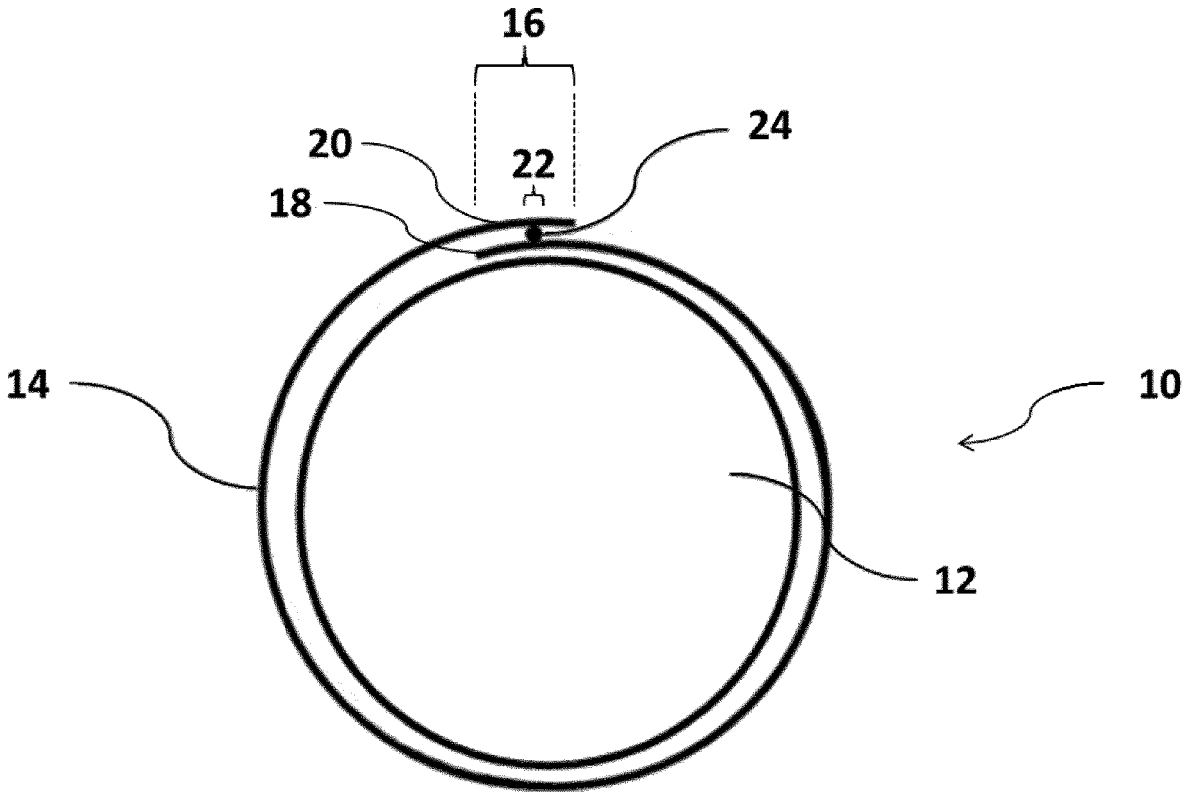
FIG. 1 shows a cross-sectional view of a cylindrical rod for aerosol-generating articles of the invention.

FIG. 1 shows a cross-sectional view of a cylindrical rod for aerosol-generating articles 10 of the invention. The rod 10 comprises a rod component 12 which is circumscribed by a wrapper 14. Laterally opposed edge portions of the wrapper 14 overlap in an overlapping zone 16. In the overlapping zone 16 overlapping edge portions of the wrapper 14 form an inner layer 18 of the wrapper 14 which is covered by an outer layer 20 of the wrapper 14. In a glue zone 22 glue 24 is applied between the overlapping layers 18,20 of the wrapper 14. Cavities 26 are not depicted in FIG. 1.

Figure 2:
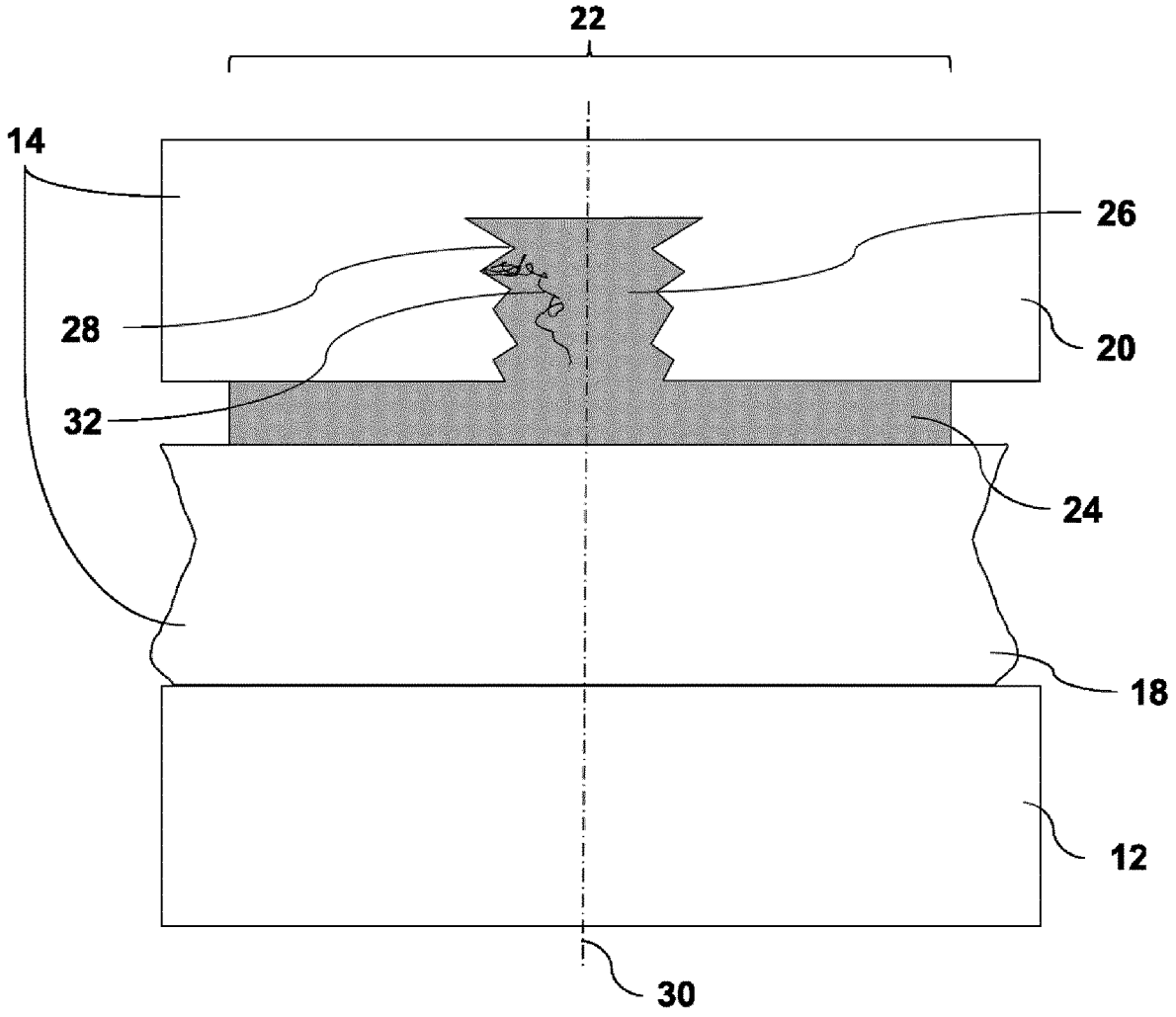
FIG. 2 shows a cross-sectional view at the glue zone of a first embodiment of a cylindrical rod for aerosol-generating articles of the invention.

FIG. 2 shows a cross-sectional view at the glue zone 22 of a first embodiment of a cylindrical rod for aerosol-generating articles 10 of the invention. In the glue zone 22, glue 24 is applied between the inner layer 18 of the wrapper 14 and the outer layer 20 of the wrapper 14, by which the overlapping edge portions of the wrapper 14 are adhered to each other.

Further, in the embodiment of FIG. 2 only the outer layer 20 comprises cavities 26. Thus, the inner layer 18 does not comprise any cavities 26. Moreover, only the inner surface of the outer layer 20 comprises cavities 26. Thus, the outer surface of the outer layer 20 does not comprise any cavities 26. The cavities 26 are recesses. Accordingly, the cavities 26 are not visible from the outside. Thereby, the visual appearance of the cylindrical rod 10 is not altered by the presence of the cavities 26.

The cavity 26 creates a caved surface of the wrapper 14. The cavity 26 is filled with glue 24. The glue 24 filling the cavity 26 acts like an anchor preventing the overlapping layers 18,20 of the wrapper 14 to move with respect to one another. The surface area of the wrapper 14 in the glue zone 22 is increased by the presence of the cavity 26. Accordingly, the total glued surface area of the wrapper 14 is increased by the presence of the cavity 26 which improves adhesion.

The wrapper 14 is made of a fibrous material. Wrapper fibers 28 are substantially aligned parallel to the plane of the wrapper 14. Therefore, inside the cavity 26 the wrapper fibers 28 are substantially aligned perpendicular to cavity axis 30. In effect, spikes are formed by wrapper fibers 28 at the surface of the cavity 26. Accordingly, the surface of the cavity 26 is roughened. The surface area is increased due to the roughening in comparison to a smooth outer surface. Hence, the total glued surface area of the wrapper 14 is additionally increased by the roughening of the surface. Thus, adhesion is additionally improved due to the roughening of the surface.

Moreover, the roughened surface provides many additional anchorages for polymeric components 32 of the glue 24. Accordingly, the glue 24 adheres more firmly to the roughened surface. This provides additional resistance against physical stress along cavity axis 30.

Figure 3:
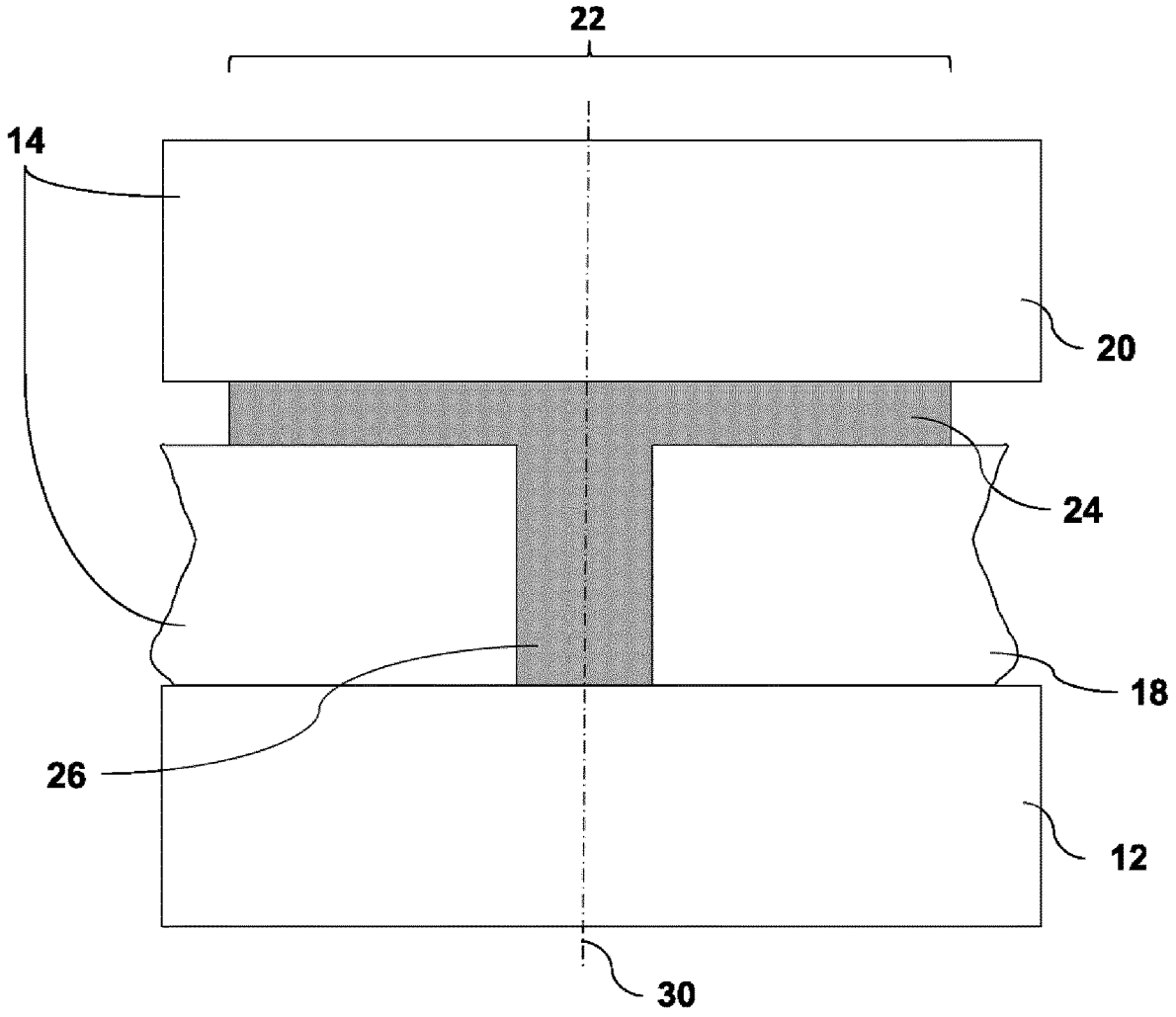
FIG. 3 shows a cross-sectional view at the glue zone of a second embodiment of a cylindrical rod for aerosol-generating articles of the invention.

FIG. 3 shows a cross-sectional view at the glue zone 22 of a second embodiment of a cylindrical rod for aerosol-generating articles 10 of the invention. In the glue zone 22, glue 24 is applied between the inner layer 18 of the wrapper 14 and the outer layer 20 of the wrapper 14, by which the overlapping edge portions of the wrapper 14 are adhered to each other.

In the embodiment of FIG. 3 the outer layer 20 does not comprise any cavities 26. The cavity 26 shown in FIG. 3 penetrates completely through the inner layer 18 so as to define a cylindrical through-hole 26 in the wrapper 14. Roughening of the surface is not depicted in FIG. 3.

The diameter of the cylindrical through-hole 26 is smaller than the thickness of the wrapper 14. Accordingly, the surface area of the wrapper 14 in the glue zone 22 which is newly created by the through-hole 26 exceeds the surface area of the wrapper 14 which has been removed by the creation of the through-hole 26. Thereby, the total glued surface area of the wrapper 14 is increased by the presence of the through-hole 26, even without taking into account any effect of roughening of the surface. Thus, adhesion is improved.

Moreover, the glue 24 penetrates completely through the through-hole 26 such that the glue 24 adheres the rod component 12 to the wrapper 14. Thus, the through-hole 26 additionally increases adhesion between the rod component 12 and the wrapper 14. Hence, the overall adhesion is increased.

In the embodiment of FIG. 3 the wrapper 14 is a tipping paper 14 and the rod component 12 is a filter plug 12. Due to the increased adhesion between the tipping paper 14 and the filter plug 12 via through-hole 26 it is less likely for the filter plug 12 to fall out of the tipping paper 14.

Figure 4:
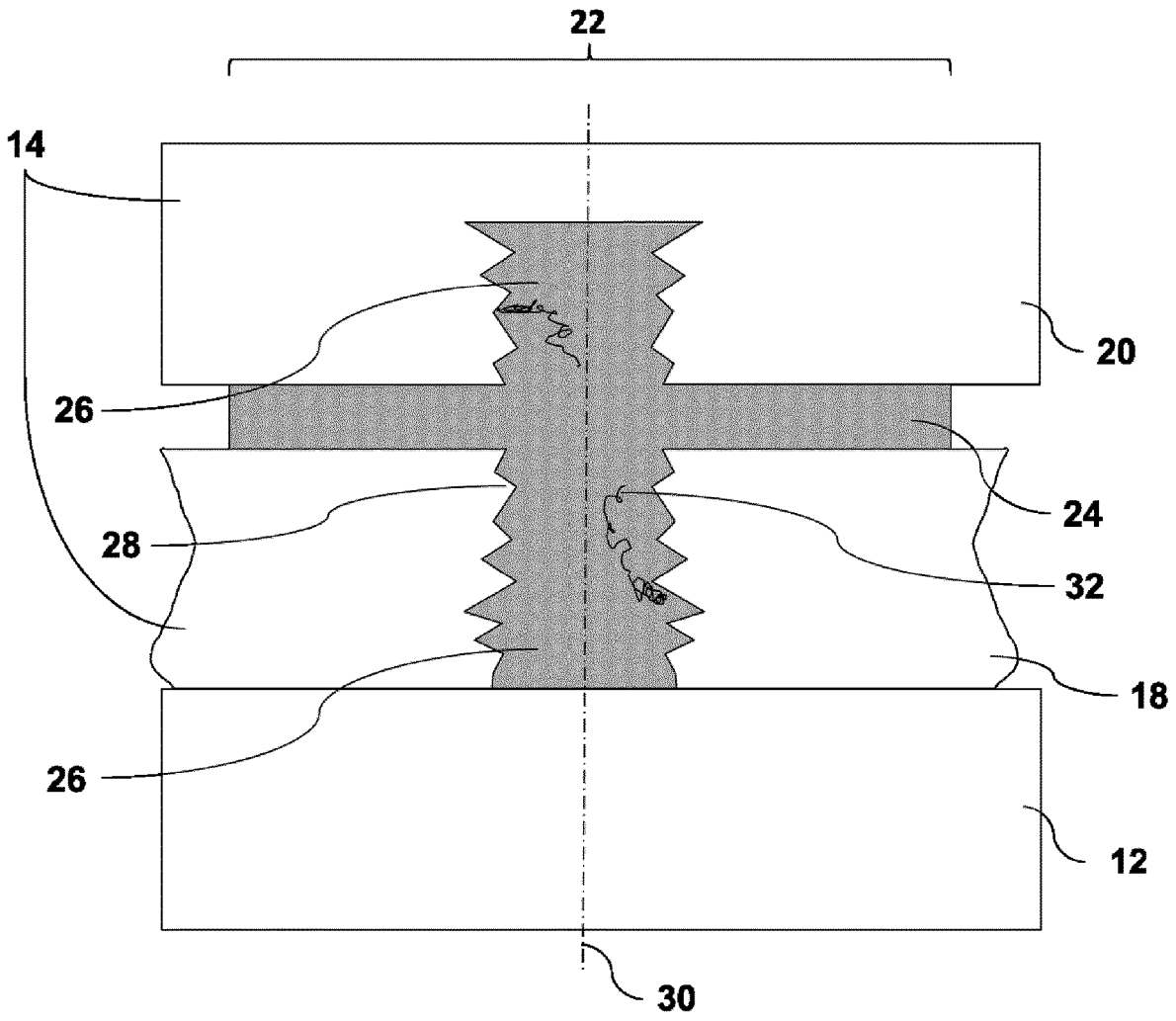
FIG. 4 shows a cross-sectional view at the glue zone of a third embodiment of a cylindrical rod for aerosol-generating articles of the invention.

FIG. 4 shows a cross-sectional view at the glue zone 22 of a third embodiment of a cylindrical rod for aerosol-generating articles 10 of the invention. In the embodiment of FIG. 4 both the inner layer 18 of the wrapper 14 and the outer layer 20 of the wrapper 14 comprise cavities 26. The cavity 26 of the inner layer 18 penetrates completely through the wrapper 14 so as to define a through-hole 26 in the wrapper 14. The cavity 26 of the outer layer 20 is a recess. Both cavities 26 have a roughened surface. The roughening is caused by the wrapper fibres 28. The roughened surfaces provide additional anchorages for polymeric components 32 of the glue 24. Accordingly, the glue 24 is more firmly adhered to both the inner layer 18 and the outer layer 20. Thus, the inner layer 18 and the outer layer 20 are more firmly adhered to one another. Thereby, the resistance against physical stress along cavity axis 30 is improved.

The opposing cavities 26 shown in FIG. 4 are aligned with respect to cavity axis 30. However, in some embodiments in accordance to the invention the relative position of opposing cavities 26 with respect to the cavity axis 30 is arbitrary.

The invention claimed is:

1. A cylindrical rod for aerosol-generating articles comprising a rod component being circumscribed by a wrapper; the wrapper comprising:

laterally opposed edge portions which overlap so as to form an overlapping zone, wherein the overlapping zone comprises an inner layer of the wrapper and an outer layer of the wrapper, and wherein the outer layer of the wrapper comprises an inner surface of the outer layer of the wrapper being located adjacent to the inner layer of the wrapper;

glue being applied between the overlapping edge portions of the wrapper so as to form one or more glue zones within the overlapping zone; and a plurality of cavities, wherein at least part of the cavities are provided in the area of the one or more glue zones; characterized in that the inner surface of the outer layer of the wrapper comprises cavities which do not penetrate completely through the wrapper so as to define recesses in the wrapper, and the inner layer of the wrapper in the overlapping zone comprises cavities which penetrate completely through the wrapper so as to define through-holes in the wrapper.

2. The cylindrical rod according to claim 1, wherein the wrapper comprises cavities in the overlapping zone, only.

3. The cylindrical rod according to claim 2, wherein the wrapper comprises cavities in the one or more glue zones, only.

4. The cylindrical rod according to claim 1, wherein the recesses in the outer layer of the wrapper coincide with the through-holes in the inner layer of the wrapper.

5. The cylindrical rod according to claim 1, wherein the cavities are arranged in one or more lines in parallel to the longitudinal axis of the rod.

6. The cylindrical rod according to claim 5, wherein the cavities are equidistantly arranged in one line with a nearest neighbor distance of between 0.1 millimeter and 0.3 millimeter.

7. The cylindrical rod according to claim 1, wherein the outer layer of the wrapper comprises an outer surface of the outer layer of the wrapper opposite to the inner surface of the outer layer of the wrapper, and wherein the outer surface of the outer layer of the wrapper does not comprise any cavities.

8. The cylindrical rod according to claim 1, wherein only the inner layer of the wrapper comprises through-holes.

9. The cylindrical rod according to claim 1, wherein the glue penetrates completely through at least one of the through-holes such that the glue adheres the rod component to the wrapper.

10. The cylindrical rod according to claim 1, wherein the thickness of the wrapper is between 0.02 millimeter and 0.2 millimeter, and wherein the diameter of each through-hole is smaller than four times the thickness of the wrapper.

11. The cylindrical rod according to claim 1, wherein the diameter of each through-hole is less than 0.4 millimeter.

12. An aerosol-generating article comprising a cylindrical rod according to claim 1 and an aerosol-generating material.

13. A method for preparing a cylindrical rod for aerosol-generating articles, comprising the steps of providing a wrapper;

providing a plurality of cavities in a lateral edge portion of the wrapper;

providing a rod component;

placing the rod component on a surface of the wrapper;

applying glue on the lateral edge portion of the wrapper; and circumscribing the rod component with the wrapper such that laterally opposed edge portions of the wrapper define an overlapping zone of the wrapper, wherein the overlapping zone comprises an inner layer of the wrapper and an outer layer of the wrapper, and wherein the outer layer of the wrapper comprises an inner surface of the outer layer of the wrapper being located adjacent to the inner layer of the wrapper; and such that the glued area defines one or more glue zones within the overlapping zone, wherein at least part of the cavities are provided in the area of the one or more glue zones; characterized in that the inner surface of the outer layer of the wrapper comprises cavities which do not penetrate completely through the wrapper so as to define recesses in the wrapper, and the inner layer of the wrapper in the overlapping zone comprises cavities which penetrate completely through the wrapper so as to define through-holes in the wrapper.

14. The method according to claim 13, wherein the recesses in the outer layer of the wrapper coincide with the through-holes in the inner layer of the wrapper.

15. The method according to claim 13, wherein the outer layer of the wrapper comprises an outer surface of the outer layer of the wrapper opposite to the inner surface of the outer layer of the wrapper, and wherein the outer surface of the outer layer of the wrapper does not comprise any cavities.

* * * * *